United States Patent [19]

Miyazaki et al.

[11] Patent Number: 5,047,304

[45] Date of Patent: Sep. 10, 1991

[54] ELECTROPHOTOGRAPHIC PHOTOSENSITIVE MEMBER

[75] Inventors: Hajime Miyazaki; Hideyuki Takai; Shintetsu Go; Kazushi Iuchi, all of Yokohama, Japan

[73] Assignee: Canon Kabushiki Kaisha, Tokyo, Japan

[21] Appl. No.: 423,230

[22] Filed: Oct. 18, 1989

[51] Int. Cl.[5] ..... G03G 5/06

[52] U.S. Cl. ..... 430/73; 430/76; 430/58

[58] Field of Search ..... 430/58, 59, 73, 76, 430/79

[56] References Cited

U.S. PATENT DOCUMENTS

| | | | |
|---|---|---|---|
| 4,123,270 | 10/1978 | Heil et al. | 96/1.5 |
| 4,247,614 | 1/1981 | Ohta et al. | 430/79 |
| 4,251,613 | 2/1981 | Sasaki et al. | 430/72 |
| 4,251,614 | 2/1981 | Sasaki et al. | 430/79 |
| 4,256,821 | 3/1981 | Enomoto et al. | 430/59 |
| 4,260,672 | 4/1981 | Sasaki et al. | 430/72 |
| 4,268,596 | 5/1981 | Sasaki et al. | 430/72 |
| 4,278,747 | 7/1981 | Murayama et al. | 430/82 |
| 4,293,628 | 10/1981 | Hashimoto et al. | 430/58 |
| 4,619,880 | 10/1986 | Horic et al. | 430/76 |
| 4,921,770 | 5/1990 | Murayama | 430/76 |

*Primary Examiner*—John Goodrow

*Attorney, Agent, or Firm*—Fitzpatrick, Cella, Harper & Scinto

[57] ABSTRACT

An electrophotographic photosensitive member having a photosensitive layer on an electroconductive support, comprises an azo pigment represented by the general formula (1) as a charge-generating substance in the photosensitive layer (1)

wherein $A_1$ and $A_2$ are respectively an aromatic radical or an heterocyclic radical which may be linked through a linking radical; B is a radical necessary for forming together with the carbon atoms a five-membered, six-membered, or seven-membered ring which may be condensed with an aromatic ring; X is a radical condensing with the aromatic ring to form a polycyclic aromatic or heterocyclic ring; Y is oxygen, sulfur, dicyanomethylene, or cyanomethylene.

7 Claims, 1 Drawing Sheet

ELECTROPHOTOGRAPHIC PHOTOSENSITIVE MEMBER

BACKGROUND OF THE INVENTION

1. Field of the Invention

The present invention relates to an electrophotographic photosensitive member, particularly to an electrophotographic photosensitive member containing an azo pigment having a specified structure as a charge-generating substance.

2. Related Background Art

The organic photosensitive members are practically used which are mainly composed of an electrophotosensitive polymer, as an organic photosensitive substance, typified by poly-N-vinylcarbazole, and charge transfer complexes thereof with a Lewis acid such as 2,4,7-trinitro-9-fluorenone. Those photosensitive members are not necessarily satisfactory in their sensitivity and durability.

On the other hand, a function-separate type of electrophotographic photosensitive member in which a charge-generating function and a charge-transporting function are respectively imparted to separate substances has achieved a remarkable improvement in sensitivity and durability which are deficient in conventional organic photosensitive members. Such function-separate type photosensitive members are advantageous in that the charge-generating substance and the charge-transporting substance can respectively be selected from a variety of substances, thus facilitating the preparation of an electrophotographic photosensitive member having any desired characterisitc. Since electrophotographic photosensitive members are being used not only for copying machines but also for laser beam printers, LED printers, etc., the function-separate type photosensitive members are suitable for providing a spectral sensitivity region in accordance with the wavelength of the light source employed.

A variety of charge-generating substances are known such as azo pigments, phthalocyanine pigments, polycyclic quinone pigments, cyanine pigments, squaric acid pigments, and pyrylium salt pigments. Among them, various kinds of azo dyes are reported because of their high light-fastness, high-charge-generating ability, and ease of synthesis.

Electrophotographic photosensitive members, for example, are known which contain an electroconductive azo pigment as a charge-generating substance in a photosensitive layer comprising functionally separated layers of a charge-generating layer and a charge-transporting layer as disclosed in U.S. Pat. Nos. 4,123,270, 4,247,614, 4,251,613, 4,251,614, 4,256,821, 4,260,672, 4,268,596, 4,278,747, and 4,293,628.

Azo pigments for the charge-generating substance are required to be stable to heat and light, to have a high charge-generating ability independently of temperature, not to change characteristics on repeated use, to have an effective spectral sensitivity range corresponding to the object of application, not to restrict the selection of the charge-transporting substance, and so on. Only limited numbers of azo pigments have been practically used because the above requirements have to be satisfied to a high degree.

SUMMARY OF THE INVENTION

An object of the present invention is to provide a novel electrophotographic photosensitive member.

Another object of the present invention is to provide an electrophotographic photosensitive member which has practical high sensitivity characteristics and has stable potential characterisitcs on repeated use.

According to an aspect of the present invention, there is provided an electrophotographic photosensitive member having a photosensitive layer on an electroconductive support, comprising an azo pigment represented by the general formula (1) as a charge-generating substance in the photosensitive layer

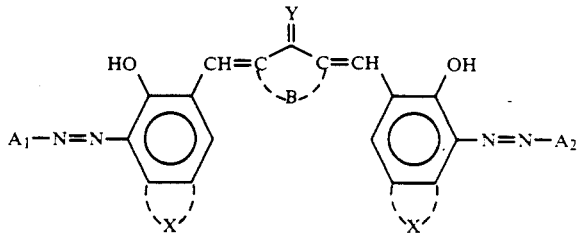

wherein $A_1$ and $A_2$ are respectively an aromatic radical or an heterocyclic radical which may be linked through a linking radical; B is a radical necessary for forming together with the carbon atoms a five-membered, six-membered, or seven-membered ring which may be condensed with an aromatic ring; X is a radical condensing with the aromatic ring to form a polycyclic aromatic or heterocyclic ring; Y is oxygen, sulfur, dicyanonmethylene, or cyanomethylene.

DETAILED DESCRIPTION OF THE PREFERRED EMBODIMENTS

Figure 1:
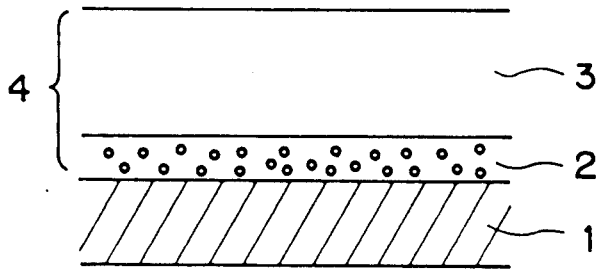
FIG. 1 is a schematic diagram illustrating an example of the layer construction of an electrophotographic photosensitive member of the present invention.

After comprehensive investigation, it has been found that an electrophotographic photosensitibve member having a photosensitive layer containing as a charge-generating substance an azo pigment represented by the general formula (1) solves the above-mentioned problems and exhibits superior electrophotographic characteristics.

In the general formula (1), $A_1$ and $A_2$ are respectively an aromatic radical or an heterocyclic radical which may be linked through a linking radical. Specific examples are hydrocarbon type aromatic groups such as benzene, naphthalene, fluorene, phenanthrene, anthracene, pyrene, etc.; aromatic radicals such as furan, thiophene, pyridine, indole, benzothiazole, carbazole, acridone, dibenzothiophene, benzoxazole, benzothriazole, oxadiazole, thiadiazole, etc.; and those in which the above aromatic or heterocyclic radicals are mutually linked directly or through an aromatic or non-aromatic radical, such as triphenylamine, diphenylamine, N-methyldiphenylamine, biphenyl, terphenyl, binaphthyl, fluorenone, phenanthrenequinone, anthraquinone, benzanthrone, diphenyloxadiazole, phenylbenzoxazole, diphenylmethane, diphenylsulfone, diphenyl ether, benzophenone, stylbene, distyrylbenzene, azobenzene, etc.

The above-mentioned aromatic radicals and the heterocyclic radicals may have a substituent. The substituents include halogen atoms such as fluorine, chlorine, and bromine; alkyl radicals such as methyl, ethyl, propyl, etc.; alkoxyl radicals such as methoxy, ethoxy, etc.; dialkylamino radicals such as dimethylamino, diethylamino, etc.; a nitro radical, a cyano radical, and a hydroxyl radical.

$A_1$ and $A_2$ may be the same, or be different from each other.

B is a radical necessary for forming with the carbon atoms a five-membered ring a six-membered ring, or a seven-membered ring which may be condensed with an aromatic ring. Specific examples are radicals necessary for forming a cyclopentane ring, a cyclohexane ring, a cycloheptane, ring, an indane ring, a dibenzocycloheptane ring, a naphthoindane ring, a dihydrophenalene ring. These five-membered rings, six-membered rings, and seven-membered rings may have a substituent. The examples of the substituents are alkyl radicals such as methyl, ethyl, butyl, etc. and halogen atoms such as chlorine, fluorine, and bromine. The aromatic ring to be condensed may have a substituent exemplified by the above-mentioned alkyl radicals and halogen radicals, a nitro radical, and a cyano radical.

X is a radical necessary for forming a polycyclic aromatic ring or a heterocyclic radical by linking with the aromatic ring. Specifically, the examples are radicals for forming a naphthalene ring, an anthracene ring, a carbazole ring, a benzocarbazole ring, a dibenzofuran ring, etc. These rings may have a substituent similar to those mentioned as the substituents for A's above.

Y is an oxygen atom, a sulfur atom, dicyanomethylene radical, or a cyanomethylene radical.

The electrophotographic photosensitive member containing the azo pigment having the structure according to the present invention exhibits practically high sensitivity characteristics and stable potential characteristics on repeated use. The reason therefor is assumed to be that the electro-attraction of the molecular center of the azo dye is intensified by the groups such as carbonyl, thiocarbonyl, cyanomethyl, etc. thus, increasing the carrier-generating ability and the carrier-injecting ability to the charge-transporting substance, retarding the deterioration of the pigment caused by light and oxygen.

The azo pigment of the present invention is easily synthesized by condensing

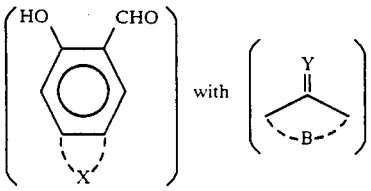

to form a coupler

-continued

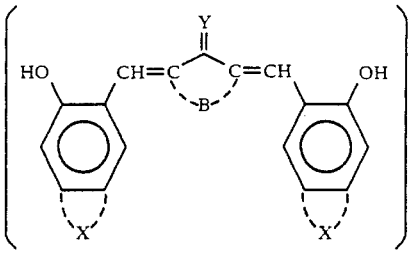

diazotizing amines corresponding to $A_1$ and $A_2$ in an conventional manner, and coupling the diazotized compound with the above-mentioned coupler; or otherwise converting the diazotized compound to a fluoborate, a zinc chloride double salt, or the like and then coupling with the above coupler in the presence of a base such as sodium acetate, pyridine, triethylamine, triethanolamine, etc. in an organic solvent such as N,N-dimethylformamide, dimethylsulfoxide, etc.

In the case where $A_1$ and $A_2$ are not the same, the synthesis may be conducted by forming the diazotized compounds

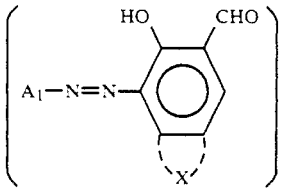

and

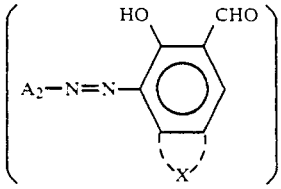

and then condensing the compounds with

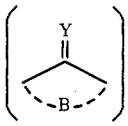

SYNTHESIS EXAMPLE (Synthesis of Compound No. 2 mentioned later)

(i) Synthesis of Coupler 10 g (58 mmols) of 2-hydroxy-3-naphthaldehyde and 3.5 g (29 mmols) of 2-indanone are together refluxed in 500 ml of ethanol for 2 hours. After cooling, the deposited crystalline product was collected by filtration, washed with methanol, washed with water, and recrystallized from methylcellosolve. The compound below was obtained with the yield of 11.2 g (90%).

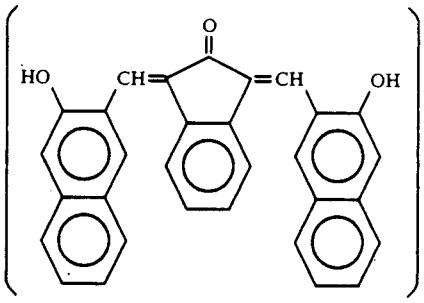

(ii) Synthesis of Diazonium Compound

In a 300 ml beaker, 150 ml of water, 42.6 ml (0.483 mol) of concentrated hydrochloric acid, and 15 g (0.161 mol) of aniline were added, and stirred and cooled to 0° C. Thereto a solution of 12.2 g (0.177 mol) of sodium nitrite in 20 ml of water was added dropwise in 10 minutes, and stirred further for 15 minutes. Carbon was added to the solution and it was filtered. To the diazotized solution, a solution of 35.1 g (0.322 mol) of sodium fluoborate in 70 ml of water was added dropwise. The deposited fluoborate salt was collected by filtration, washed with cold water, and dried under reduced pressure. The yield was 20.1 g (65%).

(iii) Synthesis of Pigment

In a 1 liter beaker, 500 ml of N,N-dimethylformamide was placed, and 10 g (23.3 mmols) of coupler which had been synthesized in the step (i) above was dissolved therein. The solution was cooled to 5° C. Then 9.4 g (48.9 mmols) of the compound

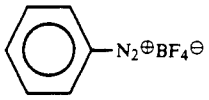

which had been prepared in the step (ii) above was dissolved therein, and 5.1 g (50 mmols) of triethylamine was added thereto dropwise and stirred at the same temperature. The reaction product was collected by filtration, and washed with 500 ml of N,N-dimethylfomamide four times, which was replaced with acetone. The product was dried under a reduced pressure. The yield was 12.1 g (80%).

The specific examples of the azo pigment of the present invention are shown below.

No. 1

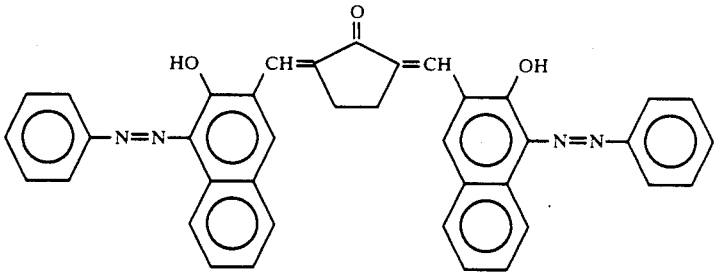

No. 2

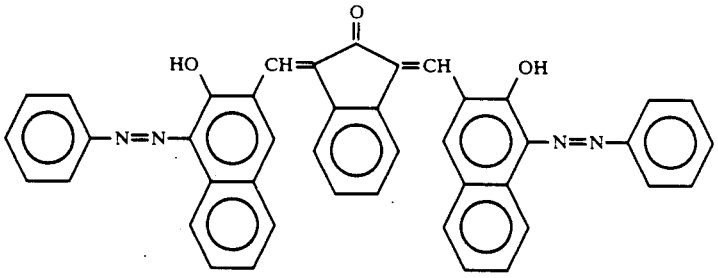

No. 3

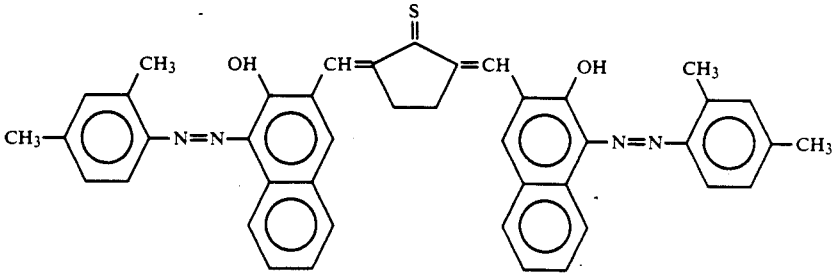

-continued
No. 4
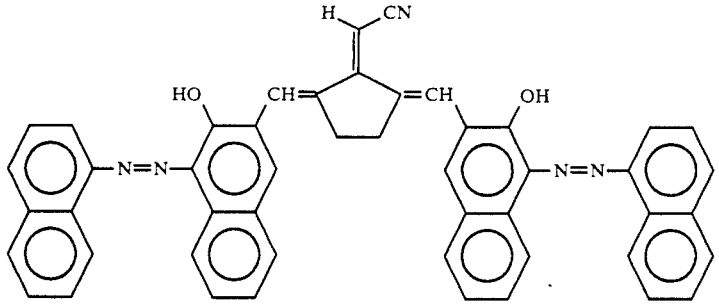
No. 5
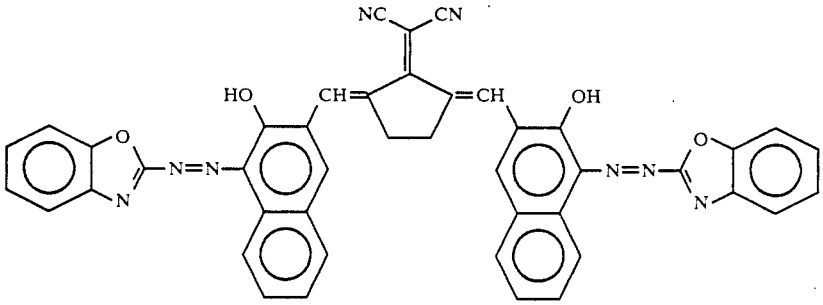
No. 6
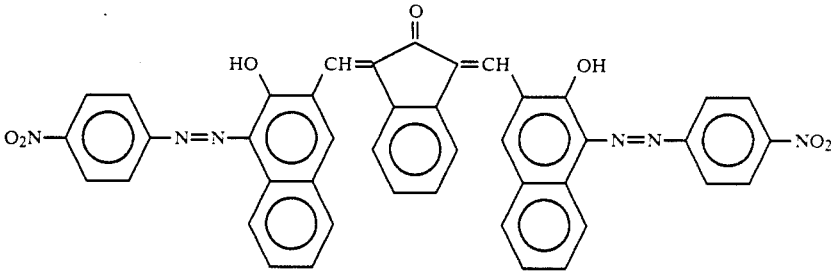
No. 7
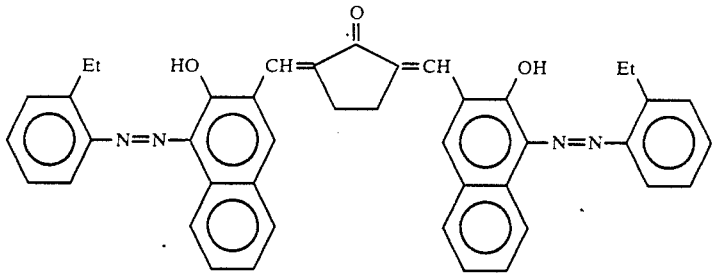
No. 8
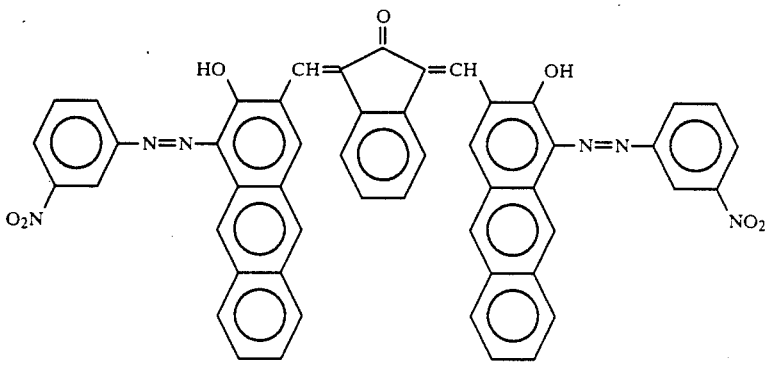

-continued
No. 9
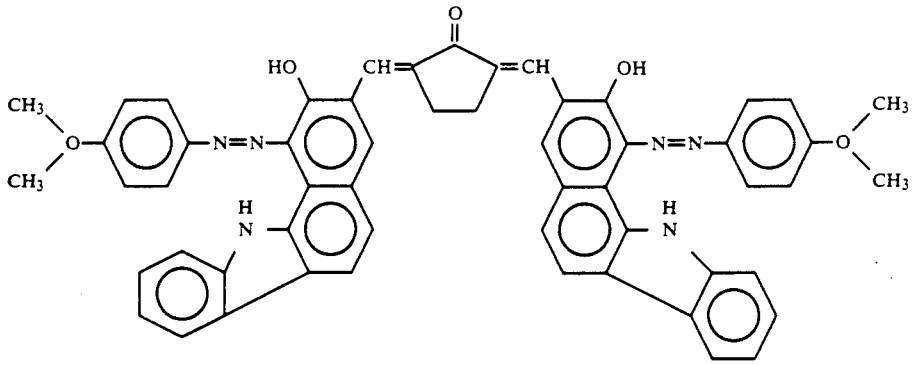
No. 10
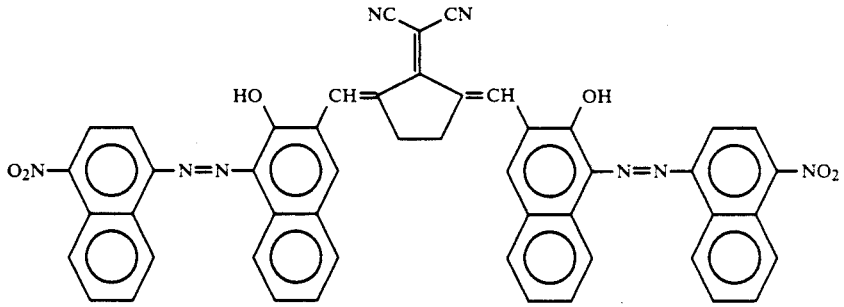
No. 11
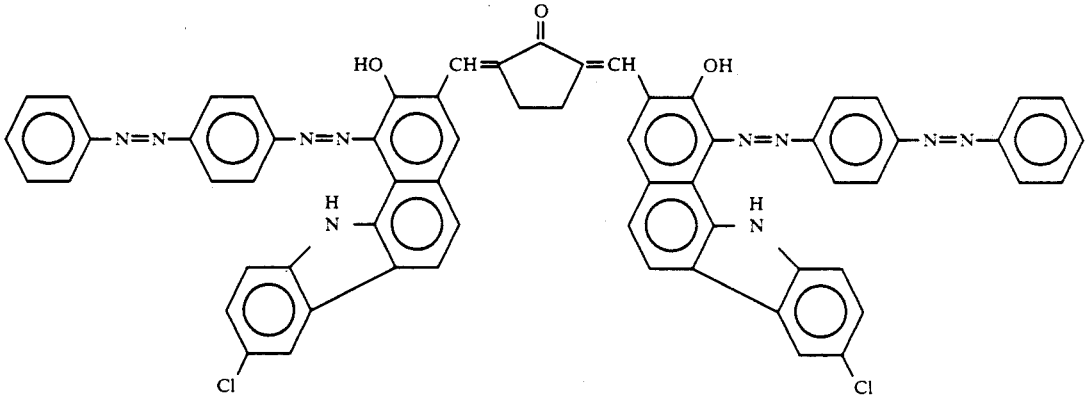
No. 12
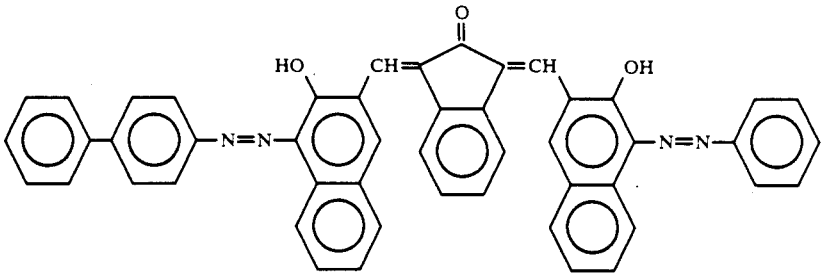
No. 13
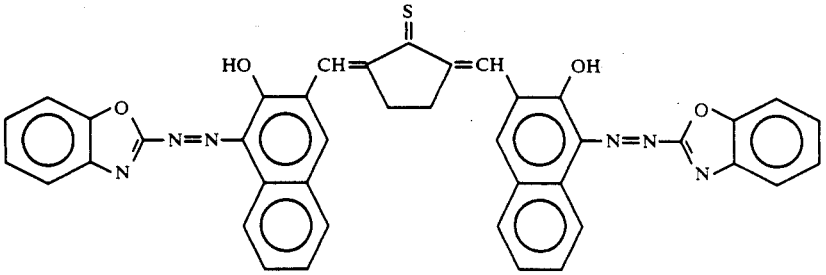

-continued
No. 14
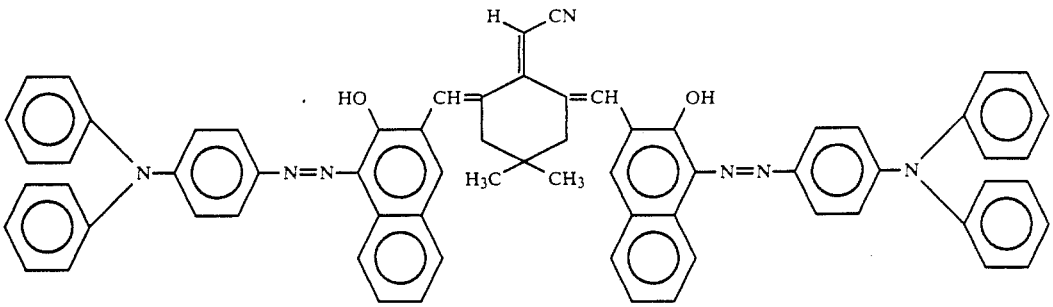
No. 15
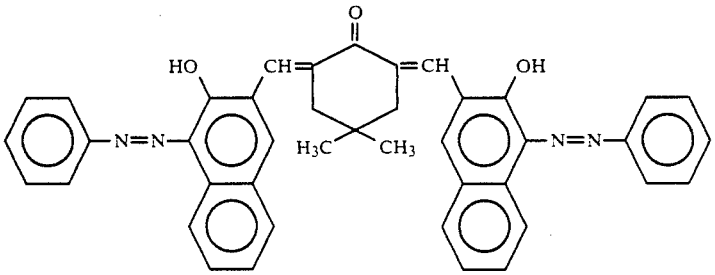
No. 16
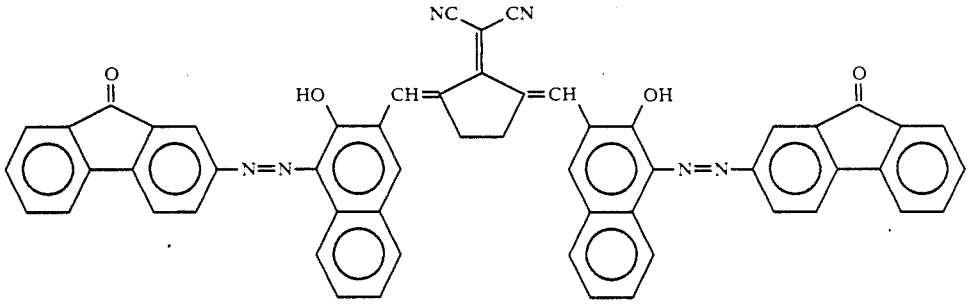
No. 17
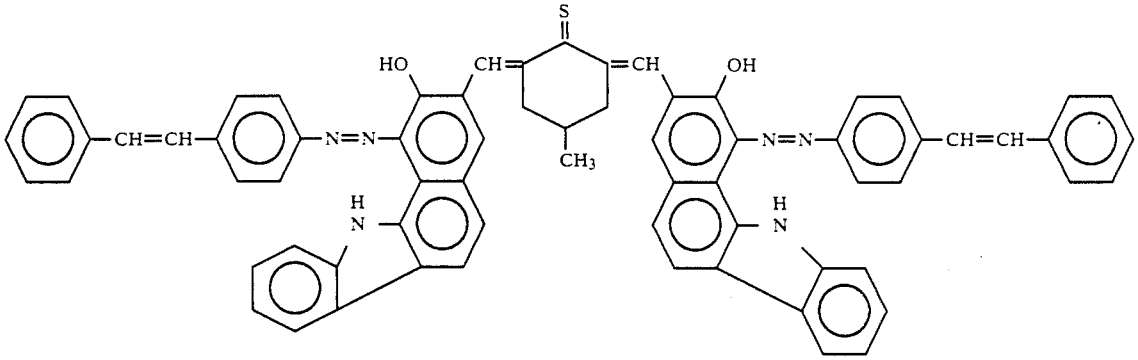
No. 18
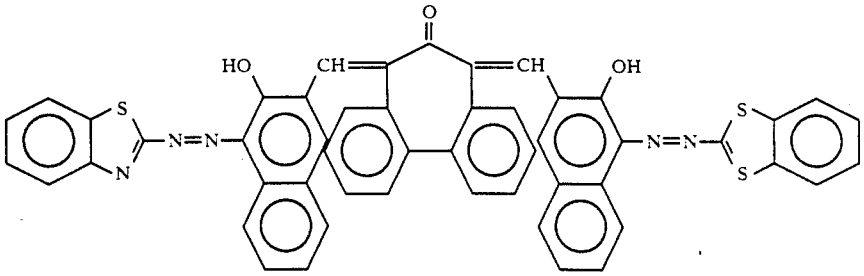

-continued
No. 19
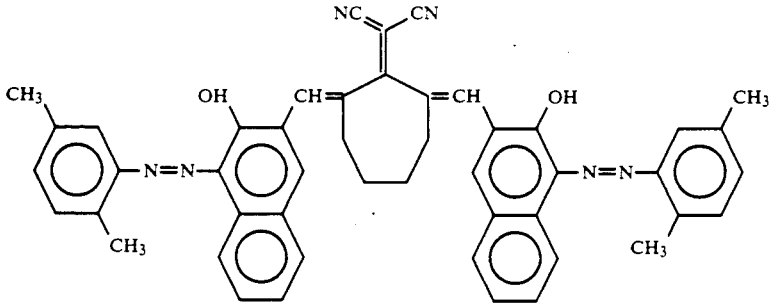
No. 20
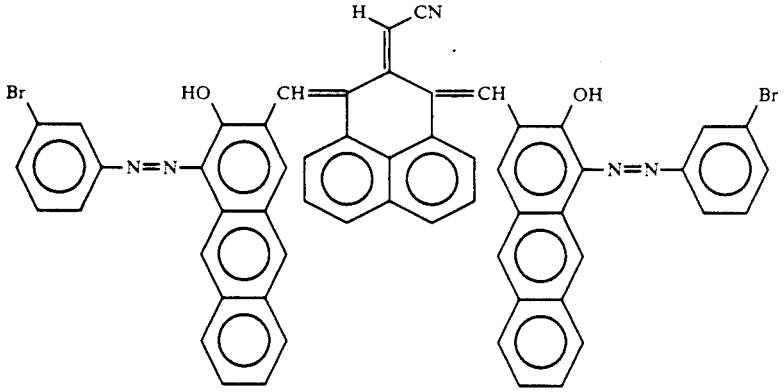
No. 21
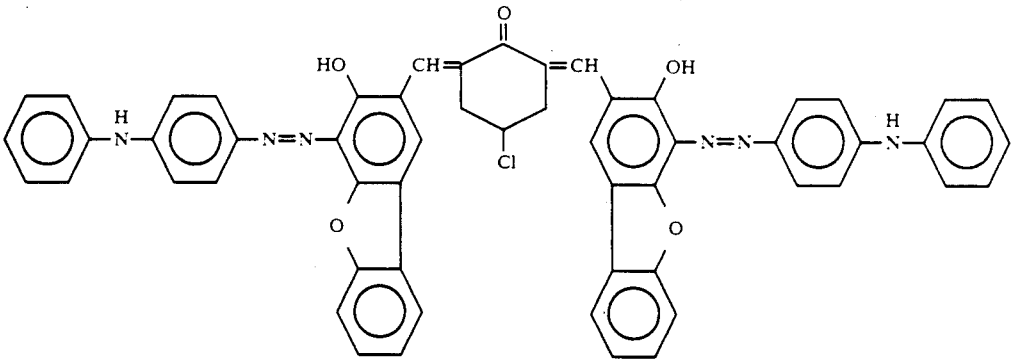
No. 22
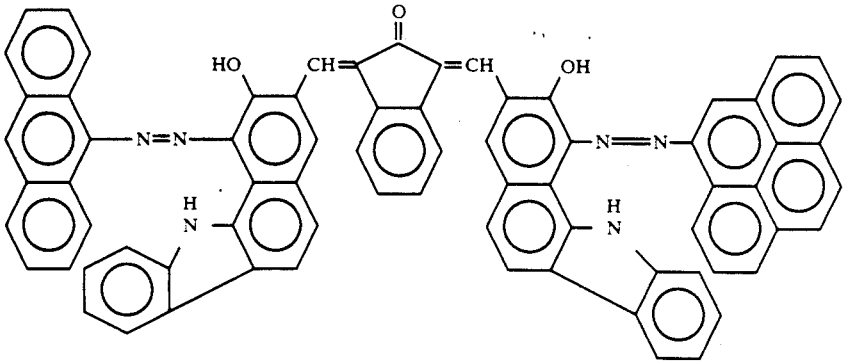

-continued
No. 23
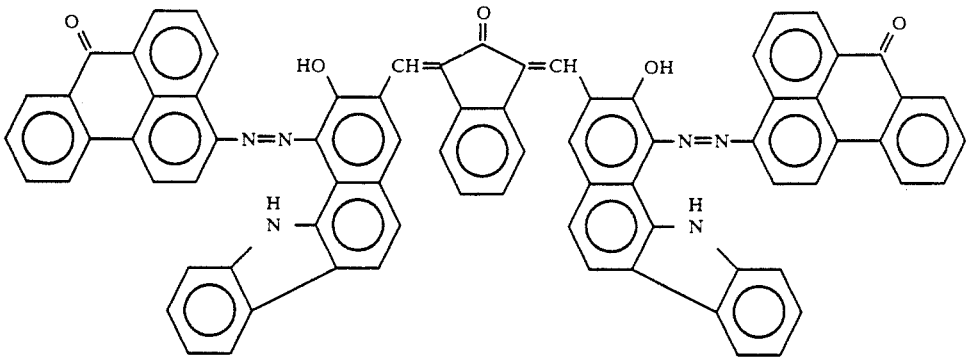
No. 24
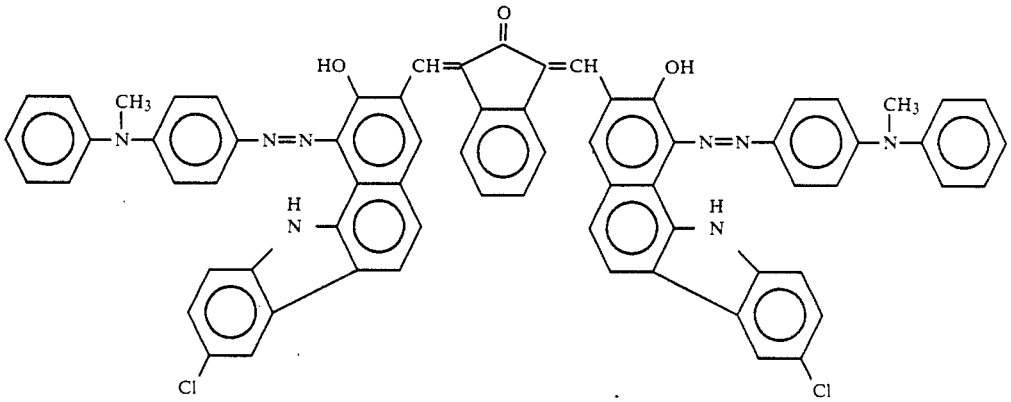
No. 25
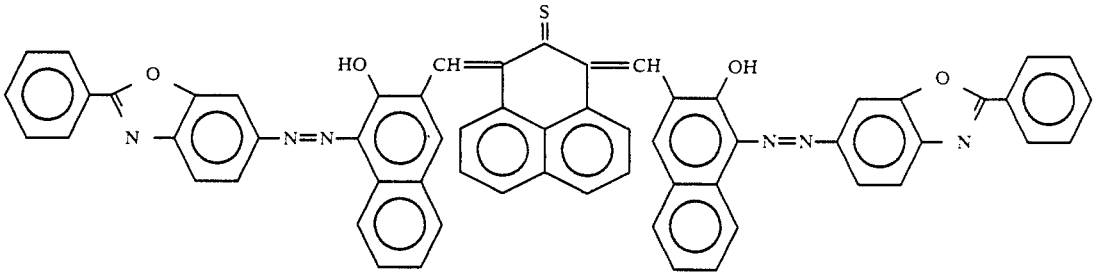
No. 26
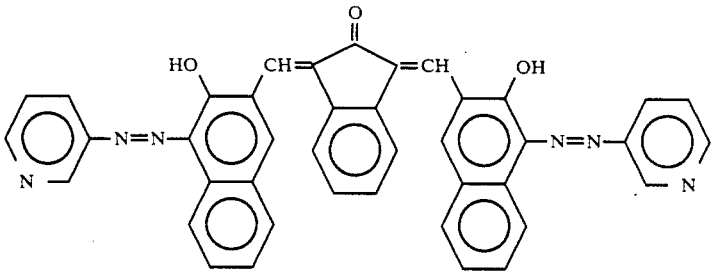
No. 27
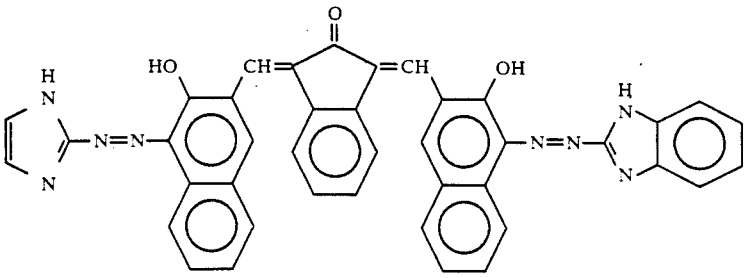

-continued

No. 28

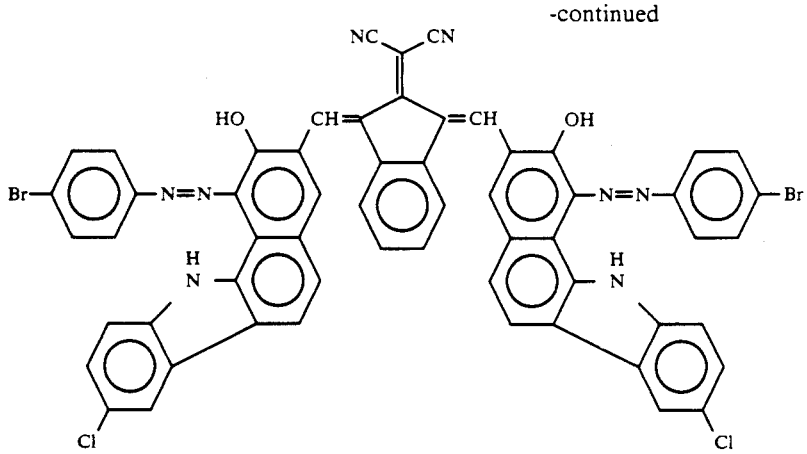

A film containing the azo pigment shown above exhibits photoconductivity, and is applicable to a photosensitive layer for an electrophotographic photosensitive member as described below.

FIG. 1 shows an example of the layer construction of the electrophotographic photosensitive member of the present invention.

In the preferred embodiment of the present invention, the above photoconductive film is applicable for a charge-generating layer in the electrophotographic photosensitive member in which a photosensitive layer 4 is functionally separated into a charge-generating layer 2 and a charge-transporting layer 3.

The charge-generating layer 2 preferably contains the aforementioned photoconductive compound in the highest amount possible in order to attain a sufficient optical absorbance, and is made into a thin film having a thickness, for example, of not more than 5 μm, preferably a thickness of from 0.01 μm to 1 μm in order to shorten the range of generated charge carriers.

The charge-generating layer 2 may be formed by dispersing the aforementioned azo pigment in a suitable binder and applying it on a support, or otherwise by vapor-depositing it into a vapor deposition film. The binders for forming a charge-generating layer by coating may be selected from a variety of insulative resins, and may also be selected from organic photoconductive polymers such as poly-N-vinylcarbazole, polyvinylanthracene, and polyvinylpyrene. Preferable examples are insulative resins including polyvinylbutyral, polyarylates (such as a plycondensate of bisphenol-A with phthalic acid), polycarbonates, polyesters, phenoxy resins, polyvinyl acetate, acrylic resins, polyacrylamide resins, polyamides, polyvinylpyridine, cellulose resins, urethane resins, epoxy resins, casein, polyvinylalcohol, and polyvinylpyrrolidone. The suitable content of the resin in the charge-generating layer is not more than 80% by weight, preferably 40% by weight.

The solvent for dissolving the resin depends on the kind of the resin, and is selected from those which do not dissolve the charge-transporting layer and the subbing layer mentioned below. The specific examples of the organic solvents are alcohols such as methanol, ethanol, and isopropanol; ketones such as acetone, methyl ethyl ketone, and cyclohexanone; amides such as N,N-dimethylformamide and N,N-dimethylacetamide; sulfoxides such as dimethylsulfoxide; ethers such as tetrahydrofuran, dioxane, and ethylene glycol monomethylether; esters such as methyl acetate, and ethyl acetate; aliphatic halogenated hydrocarbons such as chloroform, methylene chloride, dichloroethylene, carbon tetrachloride, and trichloroethylene; and aromatic solvents such as benzene, toluene, xylene, ligroin, monochlorobenzene, and dichlorobenzene.

The coating may be practiced by the use of a coating method such as to dip coating, spray coating, Mayer bar coating and blade coating. The drying is preferably conducted by first drying to the touch at a room temperature and then drying by heating. The heat drying may be conducted at a temperature in the range of from 30° C. to 200° C. for 5 minutes to 2 hours under a stationary condition or a ventilated condition.

The charge-transporting layer 3 is electrically connected with the aforementioned charge-generating layer, and has the functions of accepting charge carriers injected from the charge-generating layer and of transporting the charge carrier to the surface. The charge-transporting layer 3 may be laminated either an upper side or a lower side of the charge-generating layer.

The charge-transporting substance contained in the charge-transporting layer 3 may either be an electron-transporting substance or a positive-hole-transporting substance. The electron-transporting substance is exemplified by electron-attracting substances such as chloranil, tetracyanoethylene, tetracyanoquinodimethan, 2,4,7-trinitro-9-fluorenone, 2,4,5,7-tetranitroxanthone, and 2,4,8-trinitrothioxanthone; and polymerized products of these electron-attracting substances.

The positive-hole-transporting substance is exemplified by carbazoles such as N-ethylcarbazozle and N-methyl-N-phenylhydrazino-3-methylidene-9-ethylcarbazole; hydrazones such as p-diethylaminobenzaldehydo-N,N-diphenylhydrazone, p-diethylaminobenzaldehydo-N-α-naphthyl-N-phenylhydrazone, 1,3,3-trimethylindonylene-ω-aldehydo-N,N-diphenylhydrazone, and p-diethylbenzaldehydo-3-methylbenzothiazolinone-2-hydrazone; pyrazolines such as 1-[pyridyl(2)]-3(p-diethylaminostyryl)-5-(p-diethylaminophenyl)-pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)-pyrazoline, and spiropyrazoline; oxazoles such as 2-(p-diethylaminostyryl)-6-diethylaminobenzoxazole, and 2-(p-diethylaminophenyl)-4-(p-dimethylaminophenyl)-5-(2-chlorophenyl)oxazole; styryl compounds such as α-phenyl- 4-N,N-diphenylaminostylbene; thiazoles such as 2-(p-diethylaminostyryl)-6-diethylaminobenzothiazole; triarylmethanes such as bis(4-diethylamino-2-methylphenyl)- phenylmethane; polyarylalkanes such as 1,1-bis(4-N,N-diethylamino-2-methylphenyl)heptane, and 1,1,2,2-tetrakis(4-N,N-dimethylamino-2-methylphenyl)ethane; polyvinylpyrene, polyvinylanthracene, polyvinylacridine, poly-9vinylphenylanthracene, pyrene-formaldehyde resins, and ethylcarbazole-formaldehyde resins.

The charge-transporting substance may be used singly or two or more thereof may be used together.

A charge-transporting substance which has no film-forming property can be made into a film by employing a suitable binder. Resins useful as the binder include insulating resins such as acrylic resins, polyarylate, polyesters, polycarbonates, polystyrenes, acrylonitrile-styrene copolymers, acrylonitrile-butadiene copolymers, polyvinylbutyrals,, polyvinylformals, polysulfones, polyacrylamides, and polyamides; and organic photoconductive polymers such as poly-N-vinylcarbazoles, polyvinylanthracenes, and polyvinylpyrenes.

The charge-transporting layer 3 should not have more thickness than is needed because of the limitation in transporting of the charge carrier. The thickness is generally in the range of from 5 μm to 30 μm, preferably from 8 μm to 20 μm. The charge-transporting layer may be formed by using a suitable coating method mentioned above.

The photosensitive layer 4 of a lamination structure constituted of the charge-generating layer 2 and the charge-transporting layer 3 is provided on a electroconductive support 1. The electroconductive support 1 may be made of an electroconductive material in itself such as aluminum, an aluminum alloy, stainless steel, etc. Otherwise, the support may be made of a plastic having a coated layer formed by vacuum-vapor-deposition of aluminum, aluminum alloy, indium oxide, tin oxide, an alloy of indium oxide and tin oxide, or the like; made of a plastic or the aforementioned metallic support coated with a particulate electroconductive material such as carbon black, silver, and titanium oxide together with a suitable binder; made of a plastic or paper impregnated with a particulate electroconductive material; or made of a plastic containing an electroconductive polymer.

A subbing layer having a barrier function and an adhesion function may be interposed between the electroconductive support 1 and the photosensitive layer 4. The subbing layer may be formed from a material such as casein, polyvinyl alcohol, nitrocellulose, an ethylene-acrylic acid copolymer, a polyamide (such as nylon 6, nylon 66, nylon 610, copolymeric nylon, and alkoxymethylated nylon), a polyurethane, gelatin, aluminum oxide and the like.

The subbing layer has suitably a thickness of from 0.1 μm to 5 μm, preferably 0.5 μm to 3 μm.

In another embodiment of the present invention, a photosensitive layer may be made by adding the above-mentioned azo pigment thereto as a sensitizer, from the aforementioned organic photoconductive substance such as hydrazones, pyrazolines, styryl compounds, oxazoles, thiazoles, triarylmethanes, polyarylalkanes, triphenylamines, and poly-N-vinylcarbazoles, or from an inorganic photoconductive substance such as zinc oxide, cadmium sulfide, and selenium. The photosensitive layer may be formed as a film by coating the photoconductive substance and the azo pigment together with a binder.

A protective layer may also be provided on the photosensitive layer.

A further embodiment of the present invention is an electrophotographic photosensitive member comprising both the aforementioned azo pigment and charge-transporting substance in the same layer. In this embodiment, a charge transfer complex composed of poly-N-vinylcarbazole and trinitrofluorenone may be employed in addition to the aforementioned charge-transporting substance. The electrophotographic photosensitive member in this embodiment may be prepared by dispersing the azo pigment and the charge-transfer complex into a solution of a polyester in tetrahydrofuran, and forming a film therefrom.

In any photosensitive member, the pigment employed contains at least one pigment selected from the azo pigments represented by the general formula (1) which may be crystalline of noncrystalline.

On purpose to raise the sensitivity of the photosensitive member by using pigments different in light adsorption in a combination thereof, or to obtain a panchromatic photosensitive member, two or more azo pigments of the general formula (1) may, if necessary, be employed in a combination thereof or in combination with a charge-generating substance selected from known dyes and pigments.

The electrophotographic photosensitive member is applicable not only to electrophotographic copying machines but also to a variety of applications of electrophotography such as laser printers, CRT printers, LED printers, liquid crystal printers, and laser engraving.

The examples below are intended to illustrate specifically the present invention.

EXAMPLES 1-14

A solution of casein in an aqueous ammonia consisting of 11.2% of casein, 1 g of aqueous ammonia, and 222 ml of water was applied onto an aluminum plate so as to give a dry thickness of 1.0 μm with a Mayer bar, and dried.

To a solution of 2 g of a butyral resin butyralization degree of 63 mole %) in 95 ml of cyclohexanone was added 5 g of the azo pigment No. 2 described above and was dispersed by a sand mill for 20 hours. The dispersion was applied on the above prepared casein layer so as to give a dry thickness of 0.2 μm with a Mayer bar, and dried to form a charge-generating layer.

Subsequently 5 g of the hydrazone compound of the following structural formula

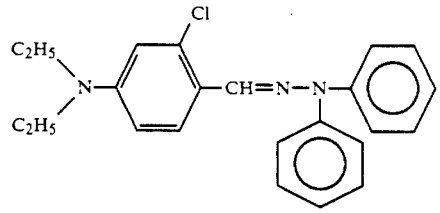

and 5 g of a polymethyl methacrylate resin (number-average molecular weight: 100,000) was dissolved in 70 ml of monochlorobenzene. The solution was applied on the charge-generating layer using a Mayer bar to give a dry thickness of 20 μm. It was dried to form a charge-transporting layer, thus providing a photosensitive member.

The photosensitive members of Examples 2-14 were prepared in the same manner except that the pigments shown in Table 1 were employed in place of the azo pigment No. 2.

The electrophotographic photosensitive members thus prepared were tested for charging characteristics, after beiing subjected to corona charging at −5.5 KV by static manner and kept for 1 second in the dark, by exposure to 5 lux of illuminance by using an electrostatic copying paper tester: Model SP-428 made by Kawaguchi Denki K.K.

The charging characteristics were measured and represented by the surface potential ($V_0$) and the quantity of the light exposure to cause potential decay to the half value (E 2/1) after one second of dark decay. The results are shown in Table 1.

TABLE 1

| Example | Disazo pigment | $V_O(-V)$ | $E_{\frac{1}{2}}$ (lux · sec.) |
|---|---|---|---|
| 1 | No. 2 | 700 | 1.5 |
| 2 | No. 1 | 710 | 3.1 |
| 3 | No. 3 | 680 | 3.4 |
| 4 | No. 4 | 690 | 3.8 |
| 5 | No. 7 | 700 | 3.6 |
| 6 | No. 9 | 720 | 2.0 |
| 7 | No. 10 | 710 | 2.3 |
| 8 | No. 15 | 710 | 2.5 |
| 9 | No. 18 | 690 | 4.0 |
| 10 | No. 22 | 680 | 2.1 |
| 11 | No. 24 | 680 | 2.0 |
| 12 | No. 25 | 700 | 1.9 |
| 13 | No. 27 | 710 | 3.0 |
| 14 | No. 28 | 710 | 2.4 |

COMPARATIVE EXAMPLE 1

A photosensitive member was prepared and the charging characteristics were evaluated in the same manner as in Example 1 except that Chlorodian Blue, a typical disazo dye, was used in place of the azo dye. The results of the evaluation are as below:

| Comparative example | Disazo pigment | $V_O(-V)$ | $E_{\frac{1}{2}}$ (lux · sec.) |
|---|---|---|---|
| 1 | Chlorodian Blue | 730 | 6.8 |

The above results show that the photosensitive members employing the azo dyes of the present invention have superior characteristics.

EXAMPLES 15-19

The changes of the light-portion potential and the dark-portion potential on repeated use were measured with the photosensitive members prepared in Examples 1, 2, 6, 8, and 12 (hereinafter referred to as Photosensitive member Nos. 1, 2, 6, 8, and 12, respectively). In the measurement, the photosensitive member was attached to a cylinder of an electrophotographic copying machine provided with a −5.6 KV corona charger, a exposure optical system, a developer, a transfer charger, a charge-eliminating exposure optical system, and a cleaner. With this copying machine, the initial light-portion potential ($V_L$) and the initial dark-portion potential ($V_D$) were set at −200 V and −700 V, respectively, and the $V_L$ and $V_D$ after 5000 times of repeated use were measured. The results are shown in Table 2.

TABLE 2

| Example | Photosensitive member No. | Initial $V_D(-V)$ | Initial $V_L(-V)$ | After 5000 times of use $V_D(-V)$ | After 5000 times of use $V_L(-V)$ |
|---|---|---|---|---|---|
| 15 | 1 | 700 | 200 | 710 | 220 |
| 16 | 2 | 705 | 200 | 695 | 210 |
| 17 | 6 | 700 | 205 | 680 | 205 |
| 18 | 8 | 695 | 195 | 695 | 205 |
| 19 | 12 | 700 | 205 | 685 | 200 |

COMPARATIVE EXAMPLE 2

The potential change with the photosensitive member prepared in Comparative example 1 was measured in the same manner as in Example 15. The result was as shown below.

| Initial $V_D(-V)$ | Initial $V_L(-V)$ | After 5000 times of repeated use $V_D(-V)$ | After 5000 times of repeated use $V_L(-V)$ |
|---|---|---|---|
| 700 | 195 | 600 | 250 |

The above result shows that the photosensitive member employing the azo pigment of the present invention exhibits less potential change on repeated use.

EXAMPLE 20

Onto the charge-generating layer prepared in Example 1, a solution of 5 g of 2, 4, 7-trinitro-9-fluorenone and 5 g of poly-4,4'-dioxydiphenyl-2,2'-propane carbonate (molecular weight: 300,000) in 70 ml of tetrahydrofuran was applied so as to give a dried film thickness of 15 μm, and the film was dried.

The electrophotographic photosensitive member thus prepared was tested for the charging characteristics in the same maner as in Example 1. In the test, the charging polarity was positive. The result is as below;

| $V_O(+V)$ | $E_{\frac{1}{2}}$ (lux · sec.) |
|---|---|
| 650 | 4.0 |

EXAMPLE 21

Onto an aluminum substrate, a solution of casein in aqueous ammonia was applied and dried to form a subbing layer of 0.5 μm film thickness.

Subsequently, 5 g of 2, 4, 7-trinitro-9-fluorenone and 5 g of poly-N-vinylcarbazole (number-average molecular weight: 300,000) were dissolved in 70 ml of tetrahydrofuran to form a charge transfer complex. The charge transfer complex and 1 g of the aforementioned azo pigment No. 5 were dispersed in a solution of 5 g of a polyester resin (VYLON: made by Toyobo Co., Ltd.) in 70 ml of tetrahydrofuran. The dispersion was applied on the subbing layer and dried to prepare a photosensitive member of 12 μm thick.

The photosensitive member thus prepared was tested for charging characteristics in the same manner as in Example 1. In the test, the charging polarity was positive. The result is as below;

| $V_O(+V)$ | $E_{\frac{1}{2}}$ (lux · sec.) |
|---|---|
| 710 | 4.8 |

EXAMPLE 22

A photosensitive member was prepared in the same manner as in Example 1 except that the layer constitution was changed such that a charge-transporting layer was formed first on the casein layer on the aluminum support and then a charge-generating layer was formed thereon.

The photosensitive member thus prepared was tested for charging characteristics in the same manner as in Example 1. In the test, the charging polarity was positive. The result is as below;

| $V_O(+V)$ | $E_{\frac{1}{2}}$ (lux · sec.) |
|---|---|
| 680 | 2.6 |

As described above, the electrophotographic photosensitive member comprising the photosensitive layer containing the azo pigment of the present invention have a practical high sensitivity characteristics, potential characteristics stable on repeated use.

We claim:

1. An electrophotographic photosensitive member having a photosensitive layer on an electroconductive support, comprising an azo pigment represented by the general formular (1) as a charge-generating substance in the photosensitive layer (1)

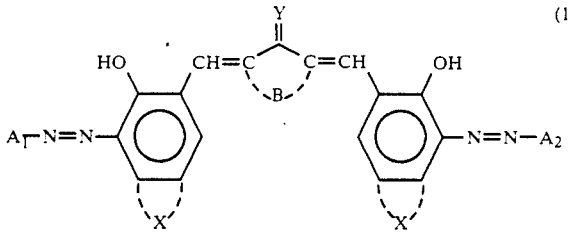

wherein $A_1$ and $A_2$ are respectively an aromatic radical or an heterocyclic radical which may be linked through a linking radical; B is a radical necessary for forming together with the carbon atoms a five-membered, six-membered, or seven-membered ring which may be condensed with an aromatic ring; X is a radical condensing with the aromatic ring to form a polycyclic aromatic or heterocyclic ring; Y is oxygen, sulfur, dicyanomethylene, or cyanomethylene.

2. The electrophotographic photosensitive member of claim 1, wherein B is a radical necessary for forming a cyclopentane ring condensed with a benzene ring, and X is a radical necessary for forming together with a benzene ring naphthalene or a compound represented by the formula:

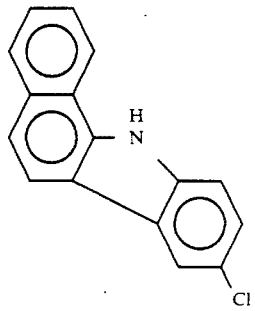

and Y is oxygen or dicyanomethylene.

3. The electrophotographic photosensitive member of claim 1, wherein the photosensitive layer is a monolayer.

4. The electrophotographic photosensitive member of claim 1, wherein a charge-generating layer and a charge-transporting layer are overlaid in this order as the photosensitive layer on a electroconductive support.

5. The electrophotographic photosensitive member of claim 1, wherein a charge-transporting layer and a charge-generating layer are overlayed in this order as the photosensitive layer on a electroconductive support.

6. The electrophotographic photosensitive member of claim 1, wherein a subbing layer is interposed between the photosensitive layer and the electroconductive support.

7. The electrophotographic photosensitive member of claim 1, wherein a protecting layer is provided on the photosensitive layer.

* * * * *

UNITED STATES PATENT AND TRADEMARK OFFICE

CERTIFICATE OF CORRECTION

PATENT NO. : 5,047,304

DATED : September 10, 1991

INVENTOR(S) : HAJIME MIYAZAKI, ET AL.

It is certified that error appears in the above-identified patent and that said Letters Patent is hereby corrected as shown below:

On the Title page, item [56] REFERENCES CITED

U.S. PATENT DOCUMENTS, "Horic et al." should read --Horie et al.--.

COLUMN 1

Line 16, "sensitive" should read --conductive--.
Line 35, "characterisitc" should read --characteristic--.

COLUMN 2

Line 8, "characterisitcs" should read --characteristics--.
Line 36, "DRAWINGS" should read --DRAWING--.
Line 45, "photosensitibve" should read --photosensitive--.
Line 53, "an" (second occurrence) should read --a--.

COLUMN 3

Line 14, "ring" (first occurrence) should read --ring,--.
Line 19, "cycloheptane," should read --cycloheptane--.
Line 49, "etc. thus," should read --etc., thus--.
Line 51, "retarding" should read --and retarding--.

COLUMN 4

Line 14, "an" should read --a--.
Line 17, "fluoborate" should read --fluoroborate--.

UNITED STATES PATENT AND TRADEMARK OFFICE

CERTIFICATE OF CORRECTION

PATENT NO. : 5,047,304

DATED : September 10, 1991

INVENTOR(S) : HAJIME MIYAZAKI, ET AL.

It is certified that error appears in the above-identified patent and that said Letters Patent is hereby corrected as shown below:

COLUMN 5

Line 25, "fluoborate" should read --fluoroborate--.
Line 26, "fluoborate" should read --fluoroborate--.

COLUMN 6

Line 24, "pigment" should read --pigments--.

COLUMN 13

Example No. 19, "OH CH" should read --HO CH--.

COLUMN 17

Line 49, "plycondensate" should read --polycondensate--.

COLUMN 18

Line 25, "to" should be deleted.
Line 37, "laminated" should read --laminated on--.
Line 49, "N-ethylcarbazozle" should read --N-ethylcarbazole--.

COLUMN 19

Line 15, "polyvinylbutyrals,," should read --polyvinylbutyrals,--.

COLUMN 20

Line 16, "of" should read --or--.
Line 40, "butyralization" should read --(butyralization--.

UNITED STATES PATENT AND TRADEMARK OFFICE

CERTIFICATE OF CORRECTION

PATENT NO. : 5,047,304

DATED : September 10, 1991

INVENTOR(S) : HAJIME MIYAZAKI, ET AL.

It is certified that error appears in the above-identified patent and that said Letters Patent is hereby corrected as shown below:

COLUMN 21

Line 5, "beiing" should read --being--.

COLUMN 22

Line 41, "maner" should read --manner--.

COLUMN 23

Line 24, "member" should read --members--.
Line 32, "formular" should read --formula--.

COLUMN 24

Line 34, "a" should read --an--.
Line 38, "overlayed" should read --overlaid--.
Line 39, "a" should read --an--.

Signed and Sealed this

Fifteenth Day of June, 1993

Attest:

Michael K. Kirk

MICHAEL K. KIRK

Attesting Officer

Acting Commissioner of Patents and Trademarks

UNITED STATES PATENT AND TRADEMARK OFFICE

CERTIFICATE OF CORRECTION

PATENT NO. : 5,047,304

DATED : September 10, 1991

INVENTOR(S) : HAJIME MIYAZAKI ET AL.

It is certified that error appears in the above-identified patent and that said Letters Patent is hereby corrected as shown below:

On the Title page,

BETWEEN [22] AND [51] INSERT:

-- [30] FOREIGN APPLICATION PRIORITY DATA

OCTOBER 20, 1988 [JP] JAPAN ..... 63-265791 --.

Signed and Sealed this

Seventeenth Day of August, 1993

Bruce Lehman

*Attest:*

BRUCE LEHMAN

*Attesting Officer*

*Commissioner of Patents and Trademarks*